US005115933A

United States Patent [19]

Gerhard

[11] Patent Number: 5,115,933

[45] Date of Patent: May 26, 1992

[54] FREIGHT CONTAINER

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 534,480

[22] Filed: Jun. 7, 1990

[30] Foreign Application Priority Data

Jun. 7, 1989 [DE] Fed. Rep. of Germany ... 8906994[U]

[51] Int. Cl.[5] ..... B65D 88/00

[52] U.S. Cl. ..... 220/1.5; 410/77; 24/287

[58] Field of Search ..... 220/1.5; 24/287, 683; 248/500, 503; 410/77

[56] References Cited

U.S. PATENT DOCUMENTS

| | | | |
|---|---|---|---|
| 3,449,801 | 6/1969 | Lafont et al. | 220/1.5 X |
| 3,456,830 | 7/1969 | Golder | 220/1.5 |
| 3,480,174 | 11/1969 | Sherwood | 220/1.5 |
| 3,553,823 | 7/1971 | Alfredsson | 220/1.5 X |
| 3,621,236 | 11/1971 | Hlinsky et al. | 24/287 X |
| 4,049,149 | 9/1977 | Dureneç | 24/287 |
| 4,626,155 | 12/1986 | Hlinsky et al. | 220/1.5 X |
| 4,741,449 | 5/1988 | Bersani | 220/1.5 |
| 4,844,672 | 7/1989 | Yurgevich | 410/77 X |

FOREIGN PATENT DOCUMENTS 1756472 6/1970 Fed. Rep. of Germany .

*Primary Examiner*—Steven M. Pollard

*Attorney, Agent, or Firm*—Evenson, Wands, Edwards, Lenahan & McKeown

[57] ABSTRACT

In order to secure small and medium-size containers having a width of e.g. 2200 mm to locking members as provided at a standard lateral spacing of 2259 mm on vehicle platforms designed for transporting ISO containers, such small or medium containers are equipped with double-fittings (12) each comprising two openings (13) and projecting beyond the width dimension of the container. The center-to-center spacing of the two openings (13) is 280 mm and thus corresponds to the distance of pairs of locking members which are provided on such platforms for engaging adjacent corner fittings of two ISO containers placed behind each other. By the simultaneous coupling to such pairs of locking members, safe securing with better distribution of forces is achieved also for containers that are shorter than the shortest ISO container.

20 Claims, 5 Drawing Sheets

FREIGHT CONTAINER

BACKGROUND OF THE INVENTION

Freight containers for use in the intermodal transportation of goods regularly comprise eight corner fittings, one at each corner, the four lower serving to secure the container to locking members such as pins or twistlocks provided on vehicle platforms, and the four upper being adapted for engagement by hoisting gear such as crane hooks or spreaders. ISO containers having standardized corner fittings are predominantly manufactured in widths of 8 ft. (2438 mm) and in lengths of 10 ft. (2991 mm), 20 ft. (6058 mm), 30 ft. (9125 mm), and 40 ft. (12192 mm), and the openings provided in the corner fittings for engaging locking members are spaced center-to-center by 2259 mm in the lateral direction and 2787 mm, or 5853 mm, or 8918 mm, or 11985 mm, respectively, in the longitudinal direction.

FIG. 1 schematically represents a plan view of the loading platform of a typical railway waggon having an overall length (without buffers) of approx. 60 ft. (about 18.3 m) for selectively receiving such freight containers. As can be seen from FIG. 1, a total of twenty-eight locking pins are provided, which are usually hinged to the platform to be individually turned down. Twenty-four of these pins are indicated at A and our are indicated at B. Up to six 10-ft. containers, or three 20-ft. containers, or two 30-ft. containers, or one 40-ft. container and one 20-ft. container etc. may be optionally secured to locking members situated at A. The pins provided at locations B serve to secure a container (or more generally: a unit load) of a non-ISO length of 35 ft. (about 10675 mm). All locking members are disposed on two axes extending in the travelling direction of the waggon at the standard spacing of 2259 mm. (It should be noted that in FIG. 1 the legends such as "10-ft cont." refer to the lengths of containers that may be secured to locking members disposed at the respective positions, whereas the actual distance between these locking members is not 10 ft etc. but shorter as explained above.)

Similar conditions exist on loading platforms of container road vehicles, with twistlocks being provided there instead of pins (that are sufficient in railway waggons).

Due to the above dimensions, there are a total of five locations on either side of the platform where pairs of locking members arranged at A are spaced by about 280 mm, as shown in FIG. 1.

Small and medium-size tank containers and unit loads have been developed for transporting small or medium quantities of flowable goods, and these containers are dimensioned so that two, three or more of them may be modularly arranged on an ISO flat ("Platform Based Container" according to ISO 1496-6), with the flat itself comprising lower corner fittings for securing to locking members arranged at the distances mentioned above. Such small or medium-sized containers typically have a width of 2200 mm and lengths of 1900 mm up to 2900 mm.

In order to handle such smaller containers of non-standard dimensions and secure them at the locking members provided on common loading platforms, U.S. Pat. No. 4,682,923 proposes latch plates disposed in two lower frame members that extend parallel to the travelling direction during transport, which latch plates have a portion that may be extracted from a corner opening and fixed at a respective one of the locking members. This arrangement permits securing the container at a transverse axis substantially coinciding with the lower front or rear container edge in the travelling direction. This type of locking involves a certain risk of the container to turn over as a result of vertical or horizontal accelerations as occur in road transport in particular.

A way to reduce this risk of tilting is known from U.S. Pat. No. 4,768,906, where latch plates are no longer provided in the region of the lower container corners, but engage openings provided in intermediate regions of the lower frame members. Again, the container is locked with respect to one transverse axis only, so that all acceleration forces occurring due to shunting bumps or braking must be taken up by a total of two locking members and two latch plates.

SUMMARY OF THE INVENTION

It is an object of the present invention to provide a freight container, particularly a small or medium size container of non-standardized overall dimensions, which is adapted for securing to locking members as are usually provided on vehicle platforms at standard spacings in such a manner that acceleration forces occurring during transport are better distributed and taken up more safely.

This object is met by a container comprising lower fittings for simultaneously securing the container to four locking members situated on a vehicle platform on two parallel straight lines spaced by substantially 2259 mm, wherein a one-piece double-fitting laterally projecting beyond the container width is provided on either container side, the fitting having openings for engaging two locking members provided on the platform at a distance of substantially 280 mm.

The invention takes advantage of the above-explained fact that on conventional vehicle loading platforms, locking members are provided in pairs with a longitudinal center-to-center spacing of 280 mm. These pairs of locking members can both be engaged by a one-piece double-fitting which projects laterally beyond the container width. Forces which occur due to shunting bumps or braking are thus distributed to a total of four locking members situated on two transverse axes and are thus, for each fixing location, divided by a factor of 2 with respect to the known arrangements.

Even if these double-fittings are arranged so that one opening coincides with a front or rear edge of the container, the chance of turning over is largely eliminated by the second opening of the same fitting situated further inside of the container. On the other hand, since the double-fitting is relatively short, it does not prevent the container from being used in flats of standard width, although it does protrude over the reduced width of the container.

While German Offenlegungsschrift 1,756,472 (in FIG. 6) discloses containers with corner fittings each having two openings, the fittings are disposed at the upper container corners and serve to couple two such containers by means of a special coupling element. Neither the reason for providing the fitting with two openings nor the spacing between the openings is stated.

The term "double-fitting" is used in this specification to designate a fitting having openings for simultaneously engaging two locking members. It must have at least two, but may have three or more openings.

Arranging the double-fittings at the end of the container is advantageous in that a container may then be used in combination with ISO containers to take optimum advantage of the available loading area. On the other hand, when the double-fittings are disposed in an intermediate region of the respective container side, an even greater safety against turning over is achieved.

In another preferred embodiment, each double-fitting is disposed on the lower side of a trapezoidal container end frame, an upper bar of which has an upper bearing surface situated vertically above the lower supporting surface of the double-fitting. Further, the upper supporting surface of the upper bar may have an upwardly extending pin and the lower bearing surface of the double-fitting has an opening aligned with the pin. This permits using the double-fittings as a stacking aid. The opening engaging the pin may be one of the openings for engagement by the locking members or provided additionally.

The double-fittings may further have the function of lateral stops for fork-lift prongs, wherein a fitting with three openings is particularly useful for bridging a larger spacing between fork-lift prongs.

In a further preferred embodiment of the invention, the double-fitting has four openings, the centers of any adjacent two of which are spaced by substantially 140 mm, with each opening having an inner length between 100 mm and 124 mm. A cut-out may be formed at either end of said double-fitting, each cut-out having the shape of a portion of an opening. The number of positions at which the container may be secured to the respective platform is thereby increased, allowing still better use of the available platform space, without substantial increase in the weight of the fitting.

Other developments of the invention relate to configurations of the double-fitting which result in sufficient thickness of the base area and high dimensional stability.

DETAILED DESCRIPTION OF PREFERRED EMBODIMENTS

Figure 2:
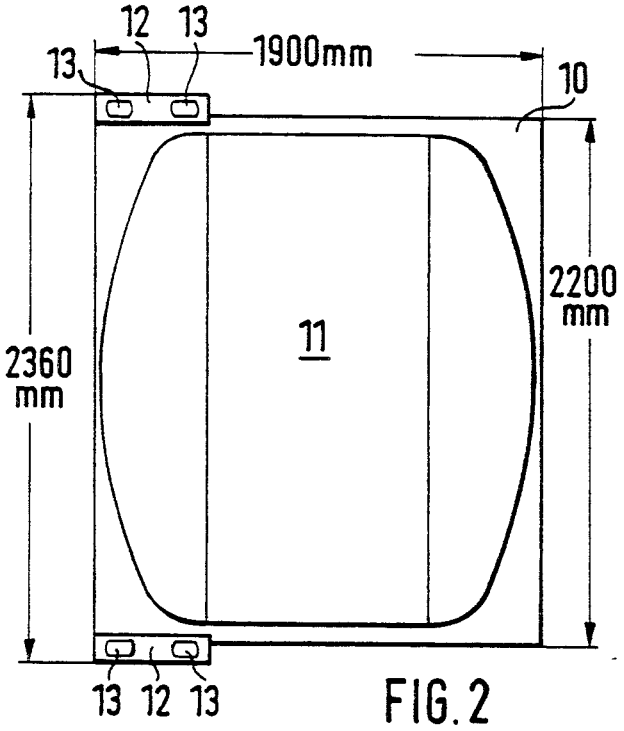
FIGS. 2 and 3 are plan views of two different freight containers having double-fittings.

The freight container represented in the schematic plan view of FIG. 2 comprises a base structure 10 supporting a tank 11. The base structure 10 may form the lower portion of a closed frame of, e.g., parallelepipedic shape, in which the tank 11 is mounted. As indicated in FIG. 2, the tank container has a frame width of 2200 mm and a frame length of 1900 mm, which in this case is shorter than the frame width. In the present specification, the designations "width" and "length" are used in such a way that the "length" extends in the travelling direction of the container transporting vehicle.

One double-fitting 12 each is welded or otherwise firmly mounted on either side of the base structure 10 so as to project beyond the frame width by such an amount that the outer limitations of the two opposite double-fittings 12 result in an overall width of less than 2400 mm (e.g. approx. 2360 mm). The double-fittings 12 are so disposed on the base structure 10 that one of their ends is in alignment with the left-hand end edge of the base structure 10 as shown in FIG. 2.

Each double-fitting 12 comprises, in its lower surface, two openings 13 at a center-to-center spacing of substantially 280 mm. Each opening 13 has the oblong shape of the aperture provided in the bottom face of an ISO-1161 bottom corner fitting. The two openings 13 are thus adapted to engage locking members disposed at the locations A in FIG. 1. As explained above, pairs of such locking members, specifically pins or twistlocks, with a center-to-center spacing of approx. 280 mm, are provided on vehicle platforms for receiving ISO containers. The lateral spacing between the openings 13 of the double-fittings 12 disposed on opposite sides of the container is 2259 mm.

Figure 3:
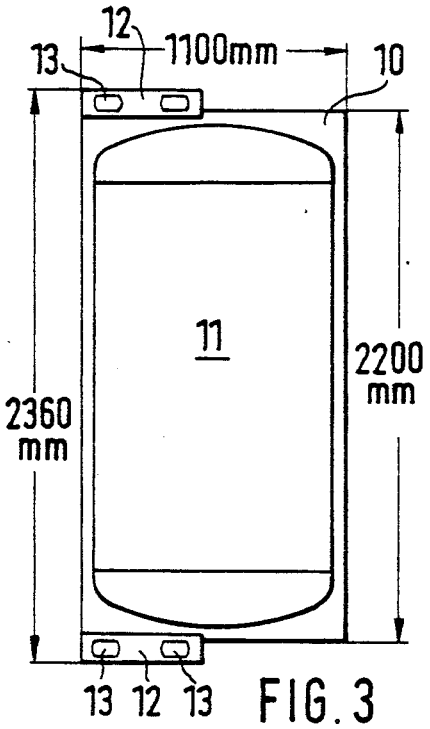

The tank container shown in FIG. 3 differs from that of FIG. 2 by a smaller capacity, the frame having a width of again 2200 mm, but a length of only 1100 mm in this case. Further, in the tank container of FIG. 3, the tank 11 is oriented so that its axis extends transversely of the longitudinal direction (travelling direction of transport vehicle).

Figure 4:
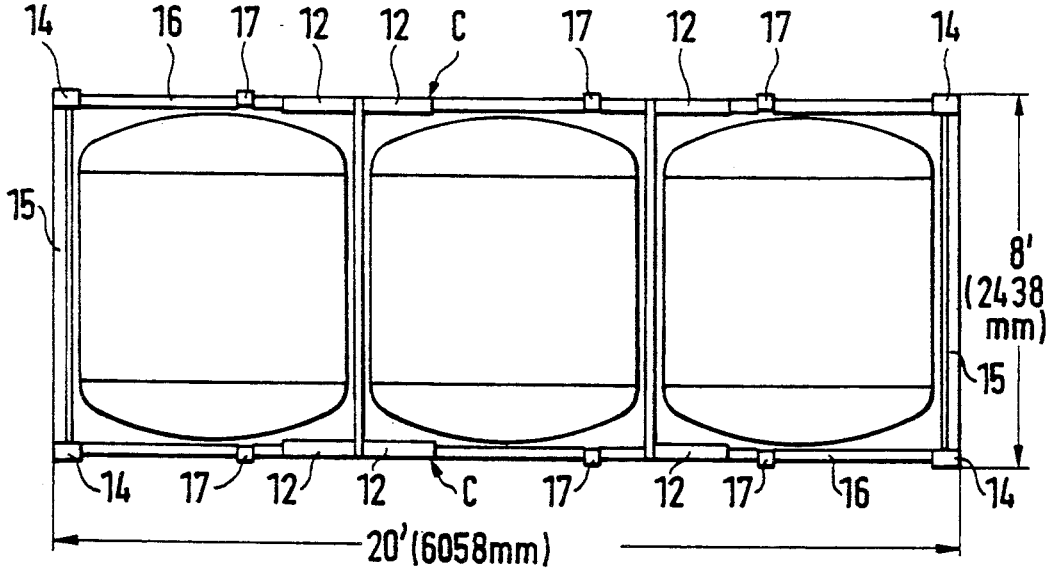
FIG. 4 is a schematic representation of an ISO flat carrying three freight containers equipped with double-fittings.

FIG. 4 shows three tank containers with frame dimensions as specified in FIG. 2, but oriented with their axes transverse to the longitudinal direction similar to FIG. 3, and arranged on an ISO flat having an external width of 8 ft. (2438 mm) and a length of 20 ft. (6058 mm).

Figure 1:
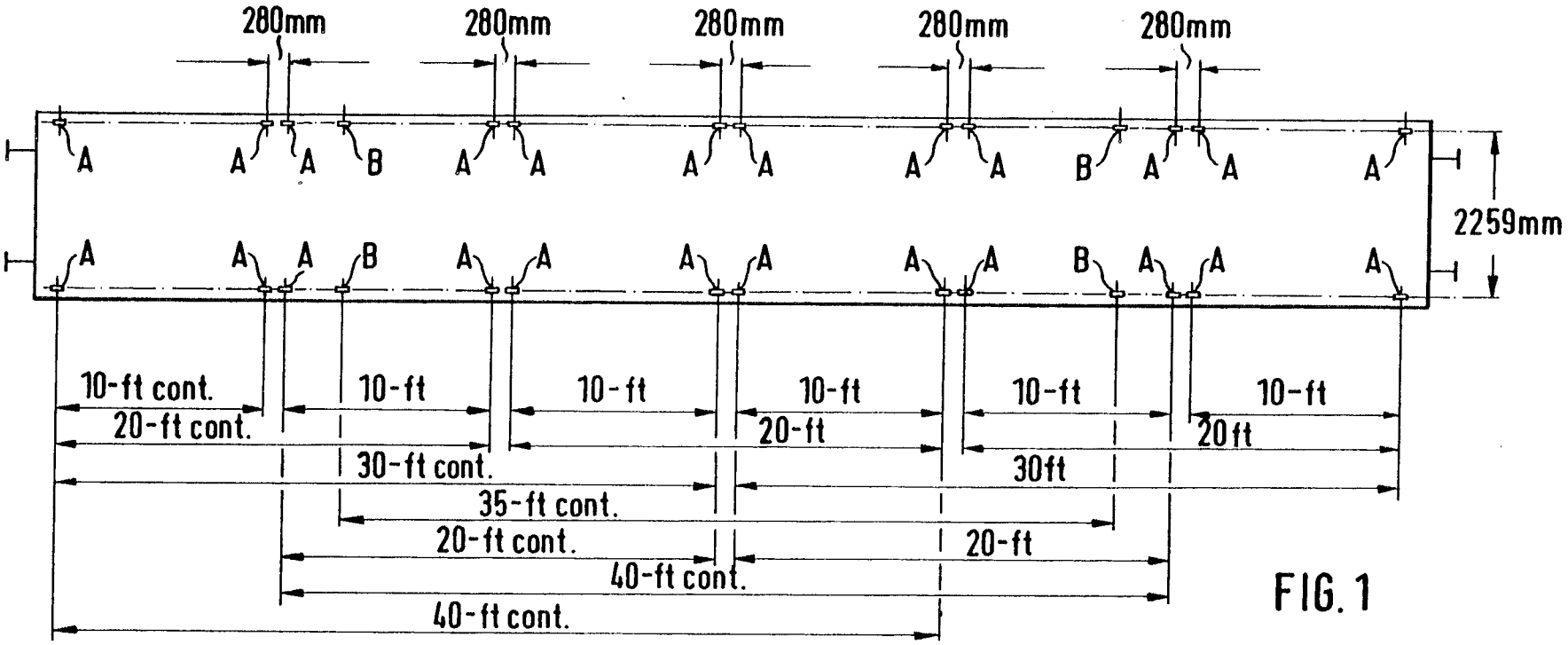
FIG. 1 (referred to above) is a schematic plan view of a vehicle loading platform.

On its four lower corners, such a flat is equipped with standard ISO corner fittings 14 with lower openings (not shown) mutually spaced in accordance with the arrangement of locking members at the locations A of a vehicle platform as shown in FIG. 1. At its ends, the flat is limited by end walls 15 which may be collapsible. The longitudinal frame members 16 are provided at several intermediate locations between corner fittings 14 with sockets for receiving upright stanchions 17.

Within the enclosure formed by end walls 15 and stanchions 17, there is sufficient space to accomodate three tank containers of the above dimensions with little clearance and mutual distance to be safely retained without additional lashing. The frame width dimension of 2200 mm of the containers is slightly smaller than the clear distance between opposite stanchions 17. The double-fittings 12 projecting beyond this width do not prevent the containers from being placed on the flat as far as they are positioned between the stanchions 17. At the locations designated by C in FIG. 4, where the double-fittings 12 of the center tank container overlap the stanchion sockets, no such stanchions are inserted, but this does not substantially impair the overall stability of laterally retaining the three containers on the flat.

Figure 6:
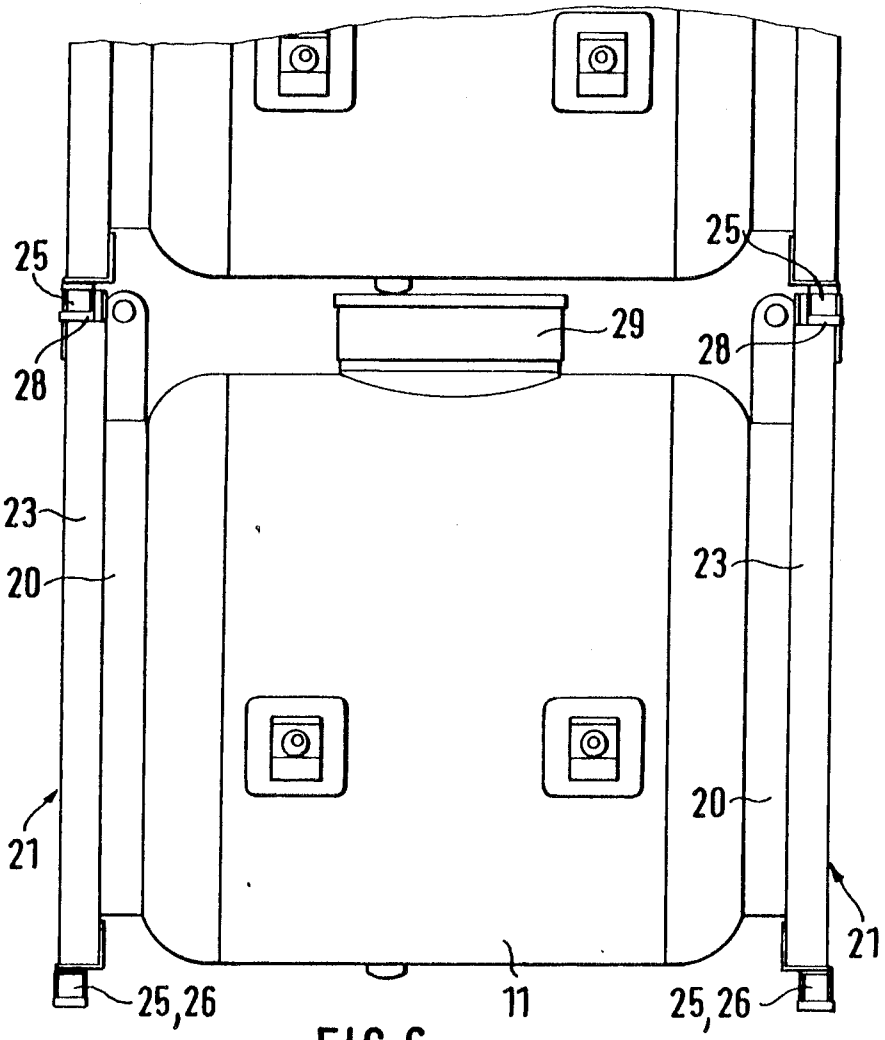
FIGS. 5 and 6 are an end and a side view of a freight container according to a further modification showing the lower portion of a similar container stacked thereon.
Figure 5:
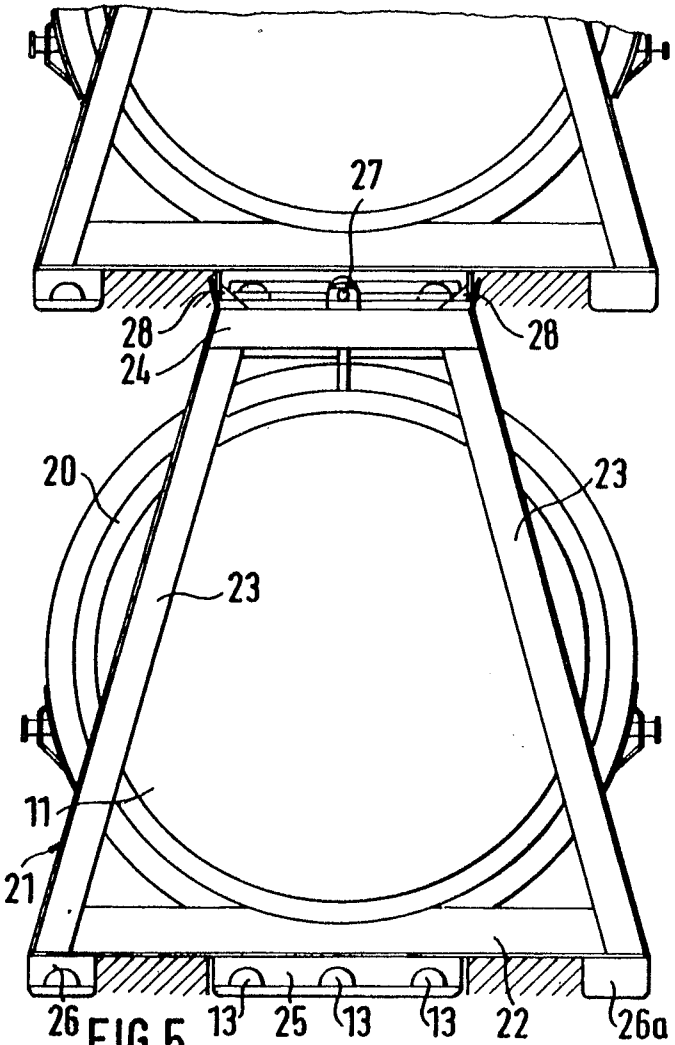

The tank container shown in FIGS. 5 and 6 comprises a self-supported tank 11 connected via end rings 20 to substantially trapezoidal end frames 21. Such a saddle-type mounting of a self-supported tank between end frames is known from U.S. Pat. No. 4,593,832. According to FIG. 5, each end frame 21 comprises a lower bar 22 the two ends of which are connected to supports 23 inclined upwards and towards each other. The upper ends of the supports 23 are interconnected via an upper bar 24.

A double-fitting 25 is mounted to the lower side of each lower bar 22 so that the outer surfaces of these two double-fittings 25 according to FIG. 6 result in an overall width of about 2360 mm (which may be up to a maximum of 2400 mm).

A single fitting 26 is additionally welded to each of the two ends of the tank container in alignment with the double-fittings 25, one edge of the single fitting terminating at a limitation of the container frame in the longitudinal direction. Another single fitting or a simple supporting block **26*a* may be symmetrically provided at the other end of the lower bar 22. The fittings 26, 26*a*** not only improve the tank container stability, but also increase the number of positions at which the tank container may be secured to the locking members available on the respective loading surface.

The double-fittings 25 of FIGS. 5 and 6 have three openings 13 for engaging locking members, the center opening being situated vertically beneath the tank axis and each of the two outer openings having a center-to-center spacing of 280 mm from the center opening. The double-fittings 25 have an overall length of about 760 mm. The hatched regions shown in FIG. 5 on both sides of the double-fitting 25 serve to receive fork-lift prongs, with the end-side limiting surfaces of the double-fitting 25 forming lateral stops for such prongs.

The length of the upper bar 24 corresponds to the length of double-fitting 25. Further, the upper bar 24 is designed so that its upper surface is situated vertically above the double-fitting 25 and may thus form a supporting surface for the lower bearing surface of a double-fitting 25 of another tank container stacked thereon.

The supporting surface of the upper bar 24 is provided with an upwardly protruding securing pin 27 disposed centrally in the longitudinal direction in alignment with the center opening 13 in the lower bearing surface of the double-fitting 25. During stacking, the pin 27 engages the center opening 13 of the double-fitting 25 of the upper tank container so that the latter is secured against sliding.

Guiding corner stops 28 fitted on the ends of the upper bar 24 serve to align the two containers when they are placed on top of each other, and to insert pin 27 more easily. The upper bar 24 with its securing pin 27 also provides a rollover protection for tank top fittings 29 as indicated in FIG. 6.

Figure 7:
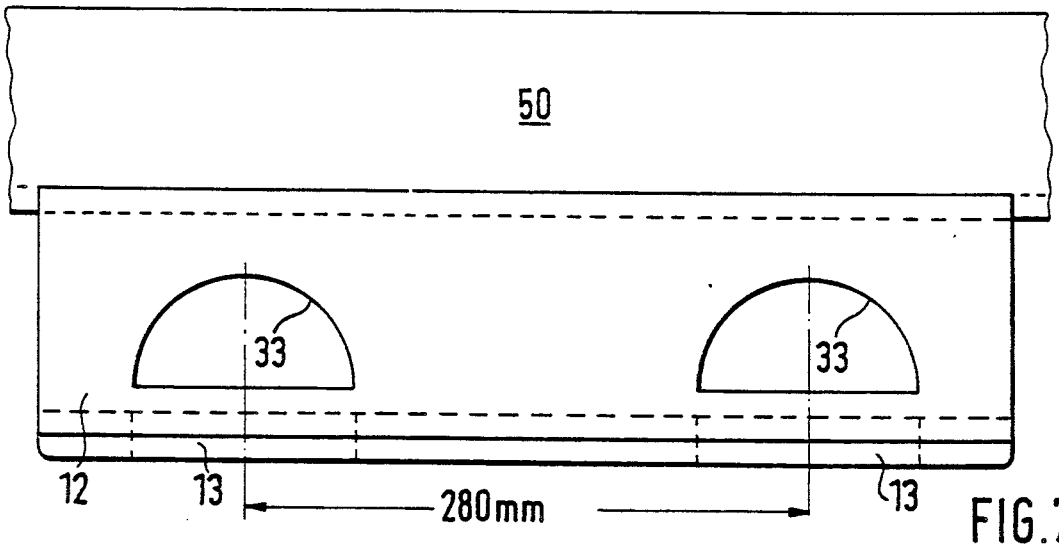
FIG. 7 is a side view of an individual double-fitting.
Figure 8:
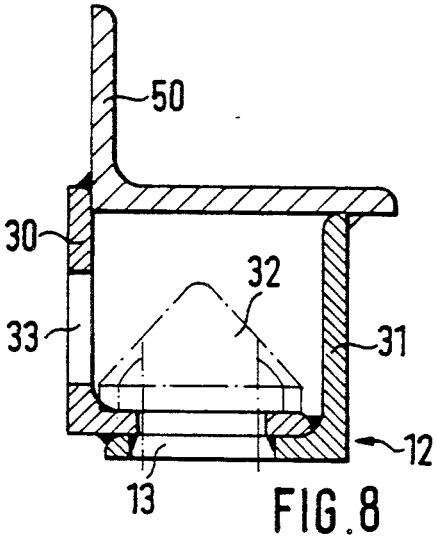
FIGS. 8 to 11 are cross-sectional views of various configurations of a double-fitting.

The double-fitting 12 represented in FIGS. 7 and 8 is formed of two L-members 30, 31 with one leg of one member overlying one leg of the other member and welded thereto so as to form an overall U-shaped cross-section with a center web of double thickness. This thickness corresponds to the height of the bead surrounding the lower aperture of a standard (ISO or UIC) bottom corner fitting and thus substantially corresponds to the height of the neck portion of a standard (ISO or UIC) twistlock indicated at 32. Both the required thickness of the center web and a high rigidity of the base region of the double-fitting are thereby obtained, whereas the overall weight of the fitting is low due to the relatively thin-walled L-profiles used. The openings 13 for engaging locking members (twistlocks 32) penetrate the web formed by the two overlying legs.

FIG. 8 also shows that the upright leg of one of the L-members 30 forming the U-shaped cross-section protrudes further upwardly than the corresponding leg of the other L-member 31. This fact is advantageously taken advantage of for vertically and laterally supporting a lower container frame member 50.

As shown in FIGS. 7 and 8, recesses 33 are provided in the upright leg of the L-member 30 facing away from the container in regions corresponding to the base openings 13, which recesses permit observing the engagement of locking members in the openings 13.

Figure 9:
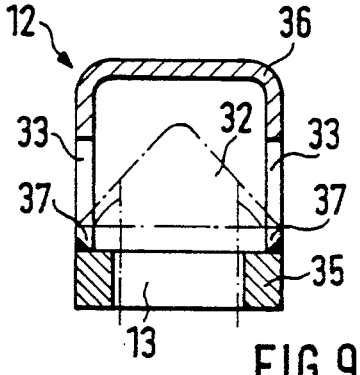

The double-fitting 12 shown in FIG. 9 differs from that of FIG. 8 in that it is constituted by a base plate 35 and a U-channel member 36 inversely welded thereon. The thickness of base plate 35 again corresponds to the height of the neck portion of a standard twistlock 32 while the thickness of the U-channel member 36 may be substantially smaller. The closed section of FIG. 9 results in a double-fitting of particularly high strength.

Further differing from the configuration of FIG. 8, the width of the double-fitting of FIG. 9 is selected so that outermost portions 37 of the twistlock head in the locked position enter recesses 33 provided in the two legs of the U-member 36. The overall width of the double-fitting 12 of FIG. 9 may thus be smaller that that of FIG. 8, while resulting in the same stability.

Figure 10:
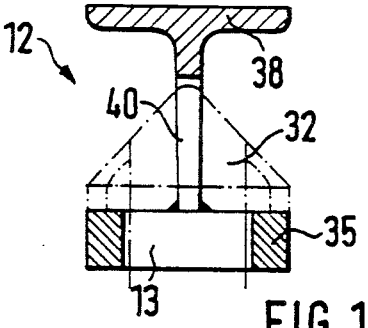
Figure 11:
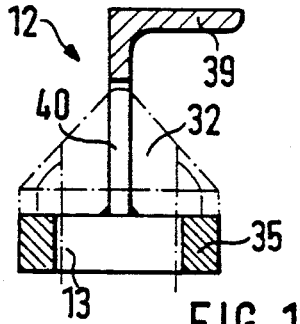

In the further modifications shown in FIGS. 10 and 11, each double-fitting 12 is formed of a base plate 35 of the same dimensions as that of FIG. 9 and a T- or L-member 38 or 39 having a downwardly extending leg welded along the center line of the base plate 35. In these embodiments, the welded leg has its lower edge provided with a semi-circular cutout 40 in the area of the opening 13 provided in the base plate 35 for receiving a twistlock head.

Figure 12:
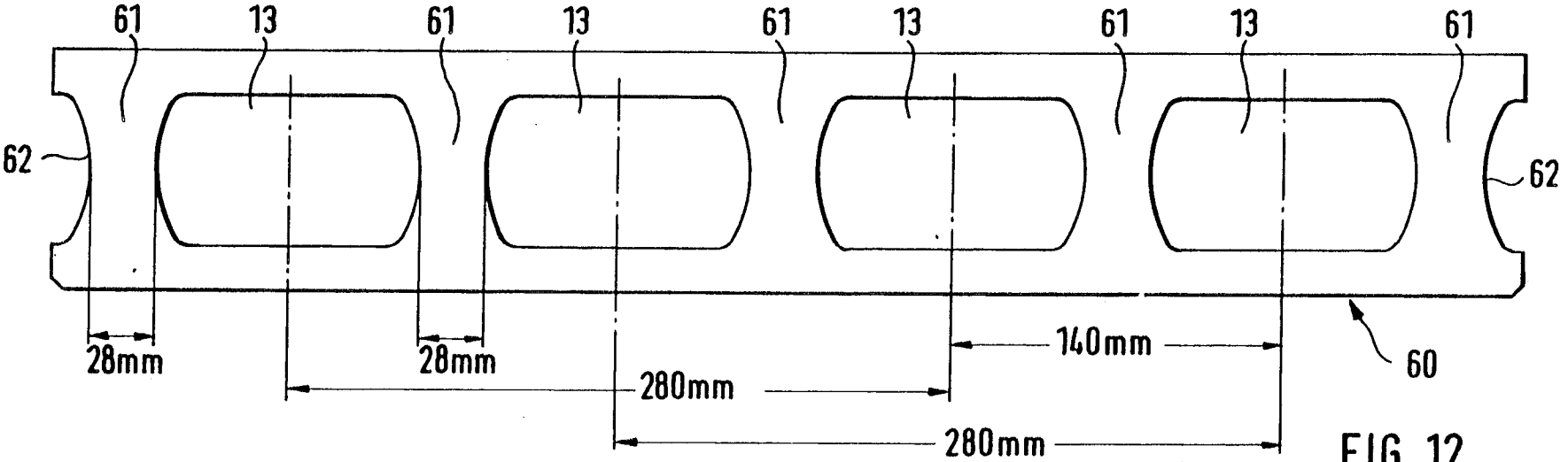
FIG. 12 is a bottom view of another double-fitting with a total of four completely closed openings.

The double-fitting 60 of FIG. 12 is provided with four completely closed openings 13, the centers of any adjacent two of which are spaced apart by about 140 mm. It may therefore be fixed in two different ways to a pair of 280-mm spaced locking members, namely with these locking members engaging the first and third, or the second and fourth openings. Since the container may be positioned with either one of its two ends facing in the forward travelling direction of the vehicle, a total of four different fixing positions of the container on the vehicle are achieved, and this versatility permits taking optimum advantage of the available platform space. Although the double-fitting 60 has a greater overall length than the two-opening fitting 12 shown in FIGS. 2 and 3, it does not involve essentially more material and weight.

The double-fitting 60 may have any suitable cross-sectional structure, specifically any of any those illustrated in FIGS. 8 to 11.

The standard length of the aperture in an ISO corner fittings is 124 mm, while that of an ISO twistlock is 100 mm. The resulting play of 24 mm allows for tolerances in the mounting of the corner fittings at the ends of large containers (up to 40 ft.) and in the position of the locking members on vehicle platforms. Much smaller tolerances are sufficient in the present case where two locking members spaced by only 280 mm are engaged. The lengths of the openings 13 in the double-fitting 60 shown in FIG. 12 is therefore reduced to 112 mm or even less in favour of a wider and stronger web 61 (28 mm) between adjacent openings 23.

A partial opening or cut-out 62 shaped like a portion of the opening 13 is formed at either end of the double-fitting 60 so as to leave a web of again 28 mm with respect to the adjacent opening. Two further (though partially incomplete and less secure) fixing positions are thus obtained in that the two locking members may engage either one of the cut-outs 62 in combination with the second or third opening 13.

The above description specifically refers to small and medium-size freight containers. The invention is not limited, however, to containers in the strict meaning of the term but is likewise applicable to flats or "unit loads" in general.

What is claimed is:

1. A freight container having a length shorter than standard containers comprising lower fittings for simultaneously securing the container to four locking members situated on a vehicle platform on two parallel straight lines spaced by substantially 2259 mm, wherein a single one-piece double-fitting laterally projecting beyond the container width is provided on either container side, the fitting having openings on the bottom surface thereof for engaging two locking members provided on the vehicle platform at a distance of substantially 280 mm.

2. The container of claim 1, wherein the double-fittings are disposed at an end of the container.

3. The container of claim 1, wherein each double-fitting is disposed in an intermediate region of the respective container side.

4. The container of claim 3, wherein each double-fitting is disposed on the lower side of a trapezoidal container end frame, an upper bar of which has an upper bearing surface situated vertically above the lower supporting surface of the double-fitting.

5. The container of claim 4, wherein the upper supporting surface of the upper bar of said end frame has an upwardly extending pin and the lower bearing surface of the double-fitting has an opening aligned with the pin.

6. The container of claim 4, wherein the length of each double-fitting is so dimensioned that its ends form lateral stops for a pair of forklift prongs.

7. The container of claim 6, wherein each double-fitting comprises three openings, one disposed centrally of the respective container end and cooperating with either one of two outer openings to engage two locking members spaced by substantially 280 mm.

8. The container of claim 1, wherein the double-fitting has four openings, the centers of any adjacent two of which are spaced by substantially 140 mm.

9. The container of claim 8, wherein each of the four openings has an inner length between 100 mm and 124 mm.

10. The container of claim 8, wherein a cut-out is formed at either end of said double-fitting, each cut-out having the shape of a portion of an opening.

11. The container of claim 1, wherein the double-fitting comprises a base portion having a thickness corresponding to the height of the neck portion of a standard twistlock.

12. The container of claim 11, wherein the double-fitting has a U-shaped cross-section formed by two L-sections overlying each other with one leg.

13. The container of claim 11, wherein the double-fitting has a closed cross-section formed by a base plate and a U-channel member inversely disposed on said plate.

14. The container of claim 11, wherein the outer surface of the double-fitting, which faces away from the container center, has recesses formed in the regions of the locking member engaging openings.

15. The container of claim 11, wherein the double-fitting is formed of a base plate and a T- or L-member having one upright leg welded to the center of the base plate, recesses being cut at the lower edge of said leg in the region of the locking member engaging openings provided in said base plate.

16. A freight container having a length shorter than standard containers comprising lower fittings for simultaneously securing the container to four locking members situated on a vehicle platform on two parallel straight lines spaced by a predetermined first distance corresponding to an industry standard spacing of freight container corner fittings, wherein a single one-piece double-fitting laterally projecting beyond the container width is provided on either container side, the fitting having openings on the bottom surface thereof for engaging two locking members provided on the vehicle platform, said openings being located a predetermined distance from one another corresponding to an industry standard center to center spacing of locking members of the vehicle platform.

17. The container of claim 16, wherein the double-fittings are disposed at an end of the container.

18. The container of claim 16, wherein each double-fitting is disposed in an intermediate region of the respective container side.

19. The container of claim 18, wherein each double-fitting is disposed on the lower side of a trapezoidal container end frame, an upper bar of which has an upper bearing surface situated vertically above the lower supporting surface of the double-fitting.

20. The container of claim 19, wherein the upper supporting surface of the upper bar of said end frame has an upwardly extending pin and the lower bearing surface of the double-fitting has an opening aligned with the pin.

* * * * *